US005381920A

United States Patent [19]

Lin

[11] Patent Number: 5,381,920

[45] Date of Patent: Jan. 17, 1995

[54] TOOL BOX HINGE STRUCTURE

[76] Inventor: Arlo H. T. Lin, No. 5, Lane 25, TaTung Rd., Wu Fong Hsiang, Taichung Hsien, Taiwan, Prov. of China

[21] Appl. No.: 173,747

[22] Filed: Dec. 21, 1993

[51] Int. Cl.[6] ..... B65D 51/04; E05D 7/10

[52] U.S. Cl. ..... 220/342; 16/261; 220/338

[58] Field of Search ..... 206/372; 220/342, 341, 220/343, 338; 16/257, 262, 261, 265, 270

[56] References Cited

U.S. PATENT DOCUMENTS

| | | | |
|---|---|---|---|
| 3,317,078 | 5/1967 | Gordon | 220/342 |
| 4,306,601 | 12/1981 | Wallis et al. | 220/342 X |
| 4,684,017 | 8/1987 | Watanabe et al. | 220/342 X |
| 4,892,189 | 1/1990 | Kunimure et al. | 220/342 X |
| 4,925,059 | 5/1990 | Harvey et al. | 220/338 X |

FOREIGN PATENT DOCUMENTS

| | | | |
|---|---|---|---|
| 1129775 | 1/1957 | France | 220/342 |

*Primary Examiner*—Bryon P. Gehman

*Attorney, Agent, or Firm*—Pro-Techtor International

[57] ABSTRACT

A tool box includes a cover shell having a rectangular socket on a back wall thereof, a bottom shell having a rectangular socket on a back wall thereof, and a hinge connected between the rectangular socket of the cover shell and the rectangular socket of the bottom shell permitting the cover and bottom shells to be turned on the hinge relative to each other, wherein the rectangular socket of either shell has two opposite projecting portions on the inside; the hinge is integrally molded from a resilient plastic material having two symmetrical parts linked by a grooved horizontal connecting portion, each part of the hinge having two hooks inserted into the rectangular socket of either shell and engaged with the projecting portions of the respective rectangular socket.

2 Claims, 4 Drawing Sheets

A-A

TOOL BOX HINGE STRUCTURE

BACKGROUND OF THE INVENTION

The present invention relates to a tool box comprised of a cover shell and a bottom shell hinged by a resilient plastic hinge.

There is known a conventional handy tool box comprised of two opposing shells hinged by a hing, and used for carrying a gas-burnt soldering iron and the related accessories. This structure of conventional handy tool box is not easy to assemble. Because the hinge is comprised of two symmetrical metal leaves connected by a metal pintle, it is not easy to fasten the hinge to the shells, and fastening elements and tools must be used when fastening the hinge to the shells.

SUMMARY OF THE INVENTION

The present invention has been accomplished to provide a tool box which eliminates the aforesaid drawbacks. It is therefore an object of the present invention to provide a tool box which is easy to assemble without the use of any fastening elements or tools. It is another object of the present invention to provide a hinge for a tool box which is integrally molded from a resilient plastic material. It is still another object of the present invention to provide a tool box which is inexpensive to manufacture.

According to the preferred embodiment of the present invention, the hinge for the tool box is integrally molded from a resilient plastic material having symmetrical hooks bilaterally disposed on two opposite sides and respectively and perpendicularly extended from a grooved connecting portion in reversed directions; either shell has a rectangular socket and two opposite projecting portions inside the rectangular socket. When the hinge is inserted into the rectangular socket on either shell, the hooks become engaged with the projecting portions, and therefore the shells are linked together by the hinge.

DETAILED DESCRIPTION OF THE PREFERRED EMBODIMENT

Figure 1:
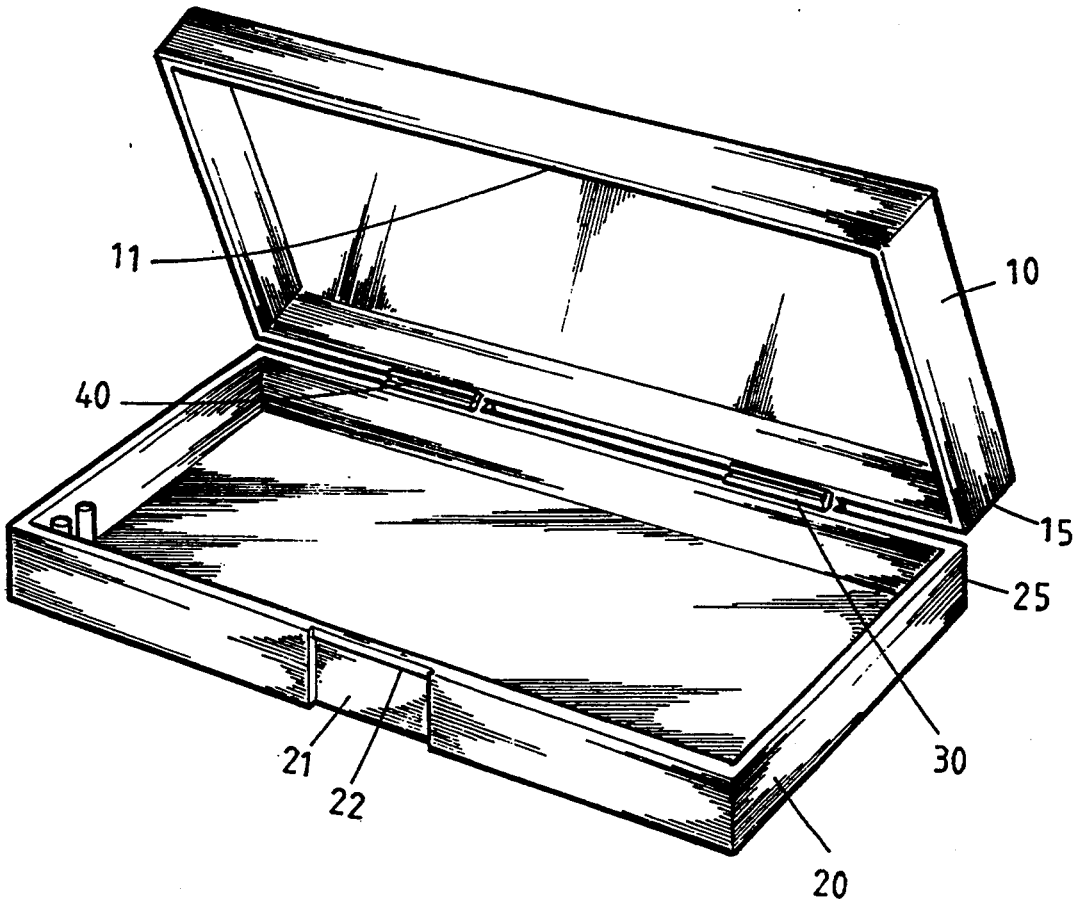
FIG. 1 is an elevational view of a tool box according to the preferred embodiment of the present invention.
Figure 2:
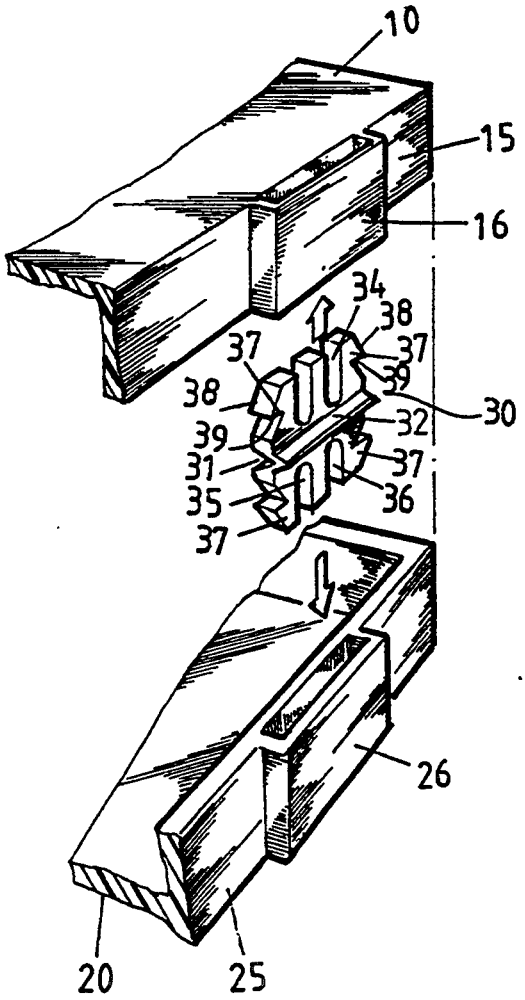
FIG. 2 is a dismantled view of the top and bottom shells and the hinge of the tool box shown in FIG. 1.
Figure 5:
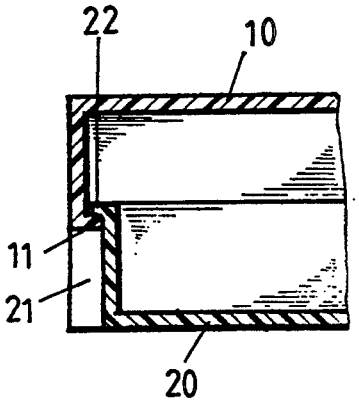
FIG. 5 is a partial view in section showing the cover and bottom shells closed.

Referring to FIGS. 1 and 2, a tool box in accordance with the preferred embodiment of the present invention is generally comprised of a cover shell 10 and a bottom shell 20. The cover shell 10 is connected to the bottom shell 20 by a hinge 30 at the back. The cover shell 10 comprises a horizontal front flange 11. The bottom shell 20 comprises a front recess 21 in the middle and a horizontal front flange 22 on the front recess. When the cover shell 10 covers on the bottom shell 20, the horizontal front flanges 11;22 are engaged with each other to hold the tool box in the closed condition (see FIG. 5).

Figure 3:
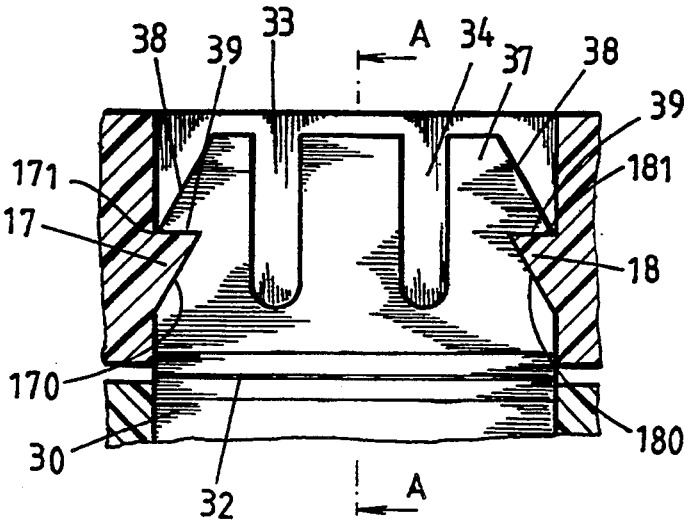
FIG. 3 is a sectional view showing the hinge inserted into the rectangular socket on either shell of the tool box of FIG. 1.

Referring to FIG. 3 and FIG. 2 again, a respective rectangular socket 16 or 26 is made on the back wall 15 or 25 of either shell 10 or 20. The rectangular socket 16 or 26 comprises two projecting portions 17;18 bilaterally and symmetrically disposed on the inside, each projecting portion 17 or 18 having a horizontal wall 171 or 181 and a sloping wall 170 or 180 gradually extended inwards from the horizontal wall 171 or 181. The hinge 30 is made from a resilient plastic material through an injection molding process, comprised of two symmetrical parts linked by a horizontal connecting portion 32, wherein each part of the hinge 30 comprises two parallel openings 33;34 or 35;36 perpendicularly extended from the horizontal connecting portion 32 in the middle, and two hooks 37 perpendicularly and bilaterally extended from the horizontal connecting portion 32. Either hook 37 comprises a horizontal wall 39 in the middle and a sloping wall 38 extended upwards inwards from the horizontal wall 39. The horizontal connecting portion 32 is made with an elongated groove 31 along the length thereof, and therefore the two symmetrical parts of the hinge 30 can be turned on the horizontal connecting portion 32 relative to each other.

Figure 4:
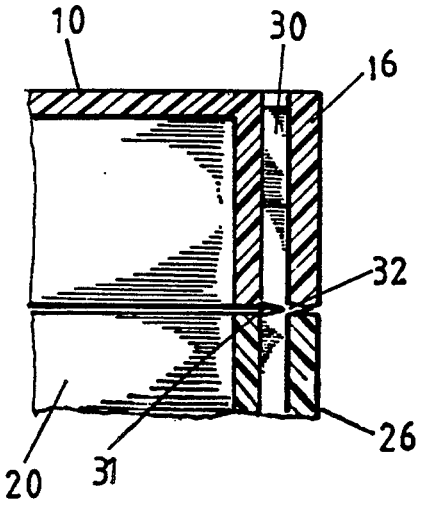
FIG. 4 is a sectional view taken along line A—A of FIG. 3.

Referring to FIG. 4 and FIG. 3 again, when either part of the hinge 30 is inserted into the rectangular socket 16 or 26 of either shell 10 or 20, the sloping walls 38 of the two hooks 37 are squeezed inwards by the sloping walls 170; 180 of the two projecting portions 17;18 of the respective rectangular socket 16 or 26. Because of the arrangement of the parallel openings 33;34 or 35;36, the hooks 37 can be flexibly squeezed inwards. When the horizontal walls 171;181 of the hooks 17 pass through the projecting portions 17;18, the hooks 17 immediately return to their former shapes causing the horizontal walls 39 thereof to engage with the horizontal walls 171;181 of the projecting portions 17;18. When the cover shell 10 and the bottom shell 20 are connected together by the hinge 30, the can be turned on the hinge 30 to close or open the tool box.

The cover shell 10 and the bottom shell 20 may be respectively made from plastics through an injection molding process. As the hinge 30 is made from a resilient plastic material through an injection molding process and connected to the rectangular sockets 16;26 of the cover and bottom shells 10;20 through hooked joints, the assembly process of the tool box is easy without the use of any external fastening elements or tools.

What is claimed is:

1. A tool box comprising a cover shell having a rectangular socket on a back wall thereof, a bottom shell having a rectangular socket an a back wall thereof, and a hinge connected between the rectangular socket of said cover shell and the rectangular socket of said bottom shell permitting said cover and said bottom shells to be turned on said hinge relative to each other, wherein the rectangular socket of each shell includes two projecting portions situated on inner surfaces of opposing side walls of said rectangular socket; the hinge is integrally molded from a resilient plastic material comprised of two symmetrical parts linked by a horizontal connecting portion, each symmetrical part of said hinge comprising two parallel openings perpendicularly extended from said horizontal connecting portion, and two hooks perpendicularly and bilaterally extended from said horizontal connecting portion, said hooks engaging with the two projecting portions of the rectangular socket of each shell.

2. The tool box of claim 1 wherein each projecting portion of the rectangular socket of either shell comprises a horizontal wall and a sloping wall extended from the horizontal wall of the respective projecting portion; each hook of said hinge comprises a horizontal wall engaged with the horizontal wall of the respective projecting portion, and a sloping wall extended upward and inward from the horizontal wall of the respective hook and stopped against the horizontal wall of the respective projecting portion.

* * * * *